US006196145B1

(12) United States Patent
Burgess

(10) Patent No.: US 6,196,145 B1
(45) Date of Patent: Mar. 6, 2001

(54) YARN INSERTION MECHANISM

(75) Inventor: Keith E. Burgess, Kennebunk, ME (US)

(73) Assignee: Albany International Techniweave, Inc., Rochester, NH (US)

( * ) Notice: Subject to any disclaimer, the term of this patent is extended or adjusted under 35 U.S.C. 154(b) by 0 days.

(21) Appl. No.: 09/438,242

(22) Filed: Nov. 12, 1999

Related U.S. Application Data

(60) Provisional application No. 60/108,729, filed on Nov. 17, 1998.

(51) Int. Cl.[7] ..... D05C 15/18
(52) U.S. Cl. ..... 112/80.16
(58) Field of Search ..... 112/80.05, 80.07, 112/80.08, 80.16, 80.4, 83, 440, 80.7, 222, 2; 428/102

(56) References Cited

U.S. PATENT DOCUMENTS

| | | | | |
|---|---|---|---|---|
| 2,599,226 | * | 6/1952 | Briem | 112/222 |
| 4,032,383 | | 6/1977 | Goldsworthy et al. . | |
| 4,256,790 | | 3/1981 | Lackman et al. . | |
| 4,331,495 | | 5/1982 | Lackman et al. . | |
| 4,549,496 | * | 10/1985 | Kile | 112/80.16 |
| 4,628,846 | | 12/1986 | Vives . | |
| 4,863,660 | | 9/1989 | Cahuzac et al. . | |
| 4,917,756 | | 4/1990 | Cahuzac et al. . | |
| 5,019,435 | | 5/1991 | Cahuzac et al. . | |
| 5,095,833 | * | 3/1992 | Darrieux | 112/2 |
| 5,429,853 | | 7/1995 | Darrieux . | |
| 5,460,673 | | 10/1995 | Cahuzac . | |

* cited by examiner

*Primary Examiner*—Ismael Izaguirre
(74) *Attorney, Agent, or Firm*—Pitney, Hardin, Kipp & Szuch, LLP

(57) ABSTRACT

The present invention is an apparatus for inserting yarns into a reinforcement material along their longitudinal path. The apparatus for moving yarn and for constraining yarn movement, such as yarn brakes, are each actuated at the appropriate time. The yarn is prevented from buckling by a hollow member of a diameter only slightly greater than the yarn, when the yarn is pushed on. The reinforcement material may be woven or non-woven fabrics, cellular foams, or combinations that may include fabrics, foams or air gaps. "Yarn" in this case is taken to include any textile yarn, monofilament, coated yarns, and the like.

36 Claims, 4 Drawing Sheets

YARN INSERTION MECHANISM

This application claims the benefit of Provisional No. 60/108,729 filed Nov. 17, 1998.

FIELD OF THE INVENTION

The present invention is directed to the field of composite materials, and apparatuses which are used to make them. More particularly, the present invention describes an apparatus for inserting yarns in a substantially longitudinal direction.

BACKGROUND OF THE INVENTION

The use of reinforced composite materials to produce structural components is now widespread, particularly in applications where their desirable properties are sought. Depending on the material, those properties include light weight, strength, toughness, thermal resistance, self-support and adaptability in terms of being formed and shaped. Such components are used, for example, in aeronautical, aerospace, satellite, battery, recreational vehicles (as in racing boats and automobiles), and other applications.

Often, the desired property in a material used to make reinforcement preforms is high strength. However, a typical characteristic of materials which exhibit that property is that their highest strength is in the direction of the long axes of the constituent fibers or filaments. For this reason, it is desirable to fabricate such reinforcement preforms to so orient the reinforcement preform constituent materials so that their long axes are substantially in the same direction as will be the forces to which the finished components will be subjected. Since those forces may be multi-directional, in some applications the reinforcement material may be oriented multi-directionally, typically in a lamination of two or more plies, to render the strength properties of the finished component operable in more than one direction, even to the point of being quasi-isotropic. By this means, such forces may be caused to be borne primarily by fibers whose long axes are oriented in the direction those forces, thus enabling the strengthening constituents of the composite structures to present their highest load-bearing capabilities to them.

Frequently, it is desired to produce components in configurations that are other than such simple geometric shapes as (per se) plates, sheets, rectangular or square solids, etc. A way to do this is to combine such basic geometric shapes into the desired more complex forms. One such typical combination is made by joining reinforcement preforms made as described above at an angle (typically a right-angle) with respect to each other. Such angular arrangements of joined reinforcement preforms create a desired shape which include one or more end walls or "T" intersections between the preforms. This arrangement may strengthen the resulting combination of reinforcement preforms and the composite structure that is produced against deflection or failure upon being exposed to exterior forces, such as pressure or tension. In any case, a related consideration is to make each juncture between the constituent components as strong as possible so forces cannot pull the composite article apart. Otherwise, given the desired very high strength of the reinforcement preform constituents per se, weakness of the juncture compared to that of each of the combined elements per se becomes the weak link in the structure.

An example of this type of intersecting configuration is where one of two constituents is an elongated, flat, planar rib that is oriented substantially at a right angle to and across a mid-span location of the other constituents, which is a planar sheet. In this structural arrangement, it is desirable to inhibit or prevent the planar sheet from deflecting objectionably or failing as pressure is applied in the direction of the width dimension of the reinforcing rib. Also, it is desirable to provide a juncture between intersecting elements (such as planar sheets per se, sheets and strips or other shapes, etc.) which will not fail when forces are applied to one of the intersecting elements in directions away from the other element which it intersects.

Various proposals have been made in the past for making such junctures. The forming and curing of a first panel element and a second angled stiffening element has been proposed, with the latter having a single panel contact surface, or otherwise bifurcated at one end to form two divergent, co-planar panel contact surfaces. The two components are then joined by adhesively bonding the panel contact surface(s) of the stiffening element to a contact surface of the other component using thermosetting adhesive or other adhesive material. However, when tension is applied to the cured panel or the skin of the composite structure, loads at unacceptably low values result in peel forces which separate the stiffening element from the panel at their interface since the effective strength of the join is that of the reinforcement material and not of the adhesive.

To use metal bolts or rivets at the interface of such components is also unacceptable because such additions at least partially destroy and weaken the composite structures themselves, add weight, and introduce differences in the coefficient of thermal expansion as between such elements and the surrounding material.

Other approaches to solving this problem have been based on the concept of introducing high strength fibers across the join area through the use of such methods as stitching one of the components to the other and relying upon the stitching thread to introduce such strengthening fibers into and across the juncture site. One such approach is shown in U.S. Pat. No. 4,331,495 and its divisional counterpart, U.S. Pat. No. 4,256,790. These patents disclose junctures between a first and second composite panels made from adhesively bonded fiber plies. The first panel is bifurcated at one end to form two divergent, co-planar panel contact surfaces, each joined to the second panel by stitches of uncured flexible composite thread through both panels. The panels and thread have then been "co-cured", i.e., cured simultaneously. This proposal is inadequate as evidenced by subsequent efforts to cope effectively with the problem of join strength.

U.S. Pat. No. 5,429,853 proposes ajoin between reinforced composite components that are in the form of a panel and of strengthening rib. One of the components is in the form of an elongated strip which is angled linearly to form a panel contacting bearing flange that is continuous with the rest of the rib which forms a stiffening flange. As disclosed, two such ribs may be joined to each other with their stiffening flanges back to back. The effect of this is effectively to create a bifurcated element having the panel contacting surfaces across the top of the "T" so formed. The bearing flange(s) of the stiffening rib are placed in contacting juxtaposition with a the surface of the panel, and the two elements (i.e., the rib and the panel) are then joined by a fibrous "filament" or thread which is inserted vertically through the panel and into the reinforcing member, with some of the filament extending into and in line with the main body of the "stiffening flange" i.e., the portion of the stiffening rib which is vertical to the plane of the panel element. The asserted effect of this is to have some of the fibers that have been introduced by the filament extend from the panel element into the stiffening flange portion of the stiffening rib. While perhaps efficacious for certain purposes, such prior art constructions still do not exhibit the desired amount of strength against failure of such joins with consequent separation of the constituent reinforced elements from each other.

SUMMARY OF THE INVENTION

The objective of the present invention is to provide an apparatus for inserting yams into a reinforcement material such as woven or non-woven fabrics, cellular foams or combinations that may include fabrics, foams or air gaps. "Yarn" in this case is taken to include any textile yam, monofilaments, coated yams, and the like.

The concept behind the apparatus is to control the motion of the yam by using means for moving yarn and means for constraining yam movement, such as yam brakes, each actuated at the appropriate time, plus a means of preventing the yarn from buckling, such as a hollow member of a diameter only slightly greater than the yarn, when the yarn is pushed on.

The present invention is an apparatus for longitudinally inserting yams into a reinforcement material wherein the invention has a housing provided with a first end for receiving yam and a second end for passing yarn, the first and second ends being in communication with means for maintaining yarn in a longitudinal path, means for moving yarn in a longitudinal path, means for actuating yarn movement, means for constraining yarn against movement, and means for boring a longitudinal path in a reinforcement material. The means for maintaining yarn in a longitudinal path may be at least one hollow member, such as a cylinder, extending longitudinally through the housing. Preferably, it is comprised of first and second hollow members in a telescoping arrangement, the first of which is stationary within the housing and the second of which is movable longitudinally. In one embodiment, the means for maintaining yarn in a longitudinal path is movable between an initial position and a second position corresponding to where yarn has been inserted into a reinforcement material, and is provided with means for engaging yarn, the engaging means being in engagement with the yarn during travel between the initial position and the second position. During return of the means for maintaining yarn in a longitudinal path from the second position to the initial position, means for constraining yarn against movement engage the yarn and keep it in the inserted position. The means for moving yarn in a longitudinal path and the means for constraining yarn against movement can be actuated pneumatically, electronically, mechanically, or electro-mechanically. The means for actuating yarn movement could be a piston coupled to the means for maintaining the yarn in a longitudinal path. In a preferred embodiment, the piston, the means for moving yarn in a longitudinal path, and the means for constraining yarn against movement are actuated pneumatically. The means for boring a longitudinal path in a reinforcement material is a hypodermic-type sewing needle provided with an opening for receiving the yarn. The hypodermic needle has a hollowed out interior and an opening at its tip, through which the yarn is fed. Yarn is carried with this needle as it moves into the reinforcement material in the direction of insertion, and remains in place (due to the aforenoted action of the means for constraining yarn against movement) as the needle is retracted after insertion.

It should be understood that the present invention permits the skilled artisan to fully realize the benefits of high performance materials which exhibit their properties isotropically. This apparatus could be used for inserting yarns, rovings, pre-impregnated yarns, monofilaments, etc, into such materials as plies of fabrics, non-woven goods such as felts, three dimensional woven preforms, foams, plies of pre-impregnated fabrics such as used in advanced composites. Some of the ways in which the present invention could be used include

- Inserting yarns into carbon fiber preforms in order to join sections of preforms of yarns prior to injecting a matrix material such as epoxy;
- Inserting fragile yarns such as NEXTEL® ceramic yarns without overwrapping them with tough yarns such as polyesters. This will save on both pre- and post-processing costs. It will also allow very small needles to be used and not require that a yarn be dragged in beside the needle. This will reduce substantially the damage caused to the fabrics by the insertion process;
- Inserting sacrificial yarns through carbon fabrics that become carbon/epoxy wing skins;
- Adding through thickness reinforcement to composite panels in order to improve the processing stresses, the interlaminar properties and the resistance to drainage propagation;
- Inserting a second kind of yarn into a reinforcement material that is comprised of a material different from the first kind of yarn. For example, the second yarn may exhibit a higher thermal conductivity than the reinforcement material, thereby improving the efficiency at which heat is removed form the reinforcement material; and
- Sewing of complex shapes without access to the backside of the structure—such as in small tubes or intricate shapes.

Prior art apparatuses are more limited in their applications. A system with the above features and the ability to invoke these features as required will cover virtually all applications envisioned for the composite materials field.

DETAILED DESCRIPTION OF THE PREFERRED EMBODIMENT

Figure 1:
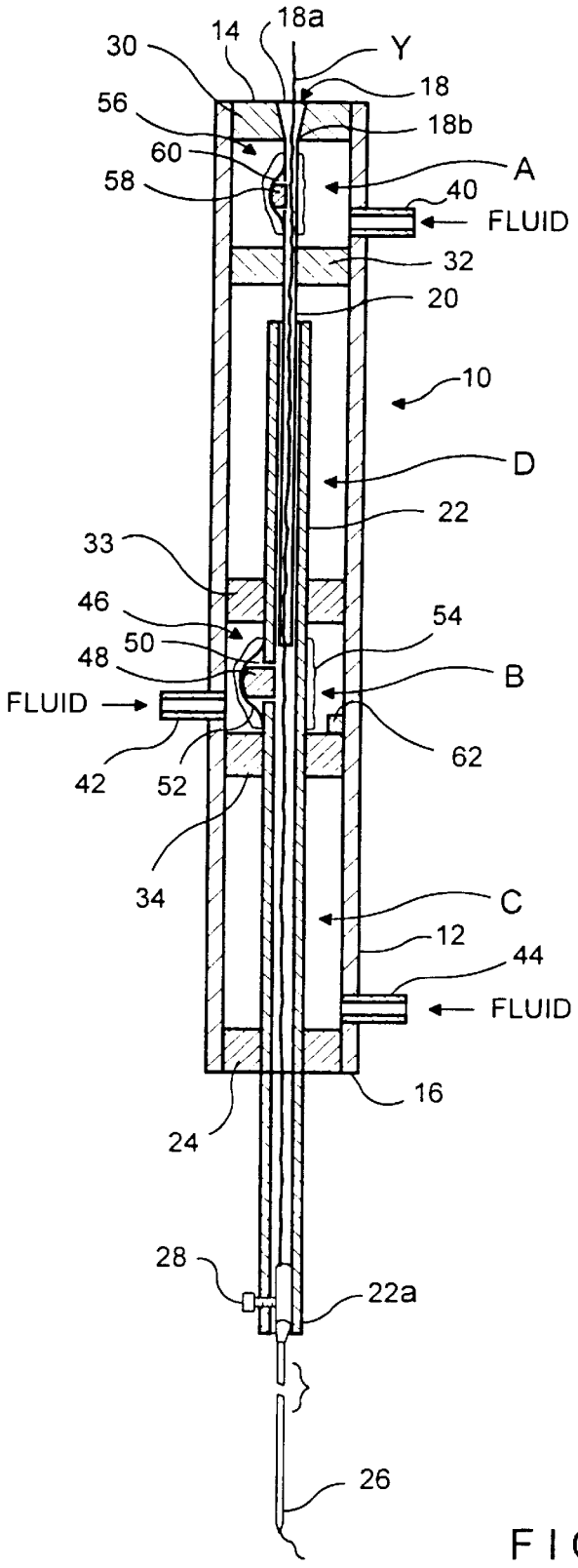
FIG. 1 is a perspective view of the preferred embodiment of the present invention.

Yarn insertion mechanism 10 is provided with housing 12 which may be cylindrical in shape. Housing 12 has first end 14 and second end 16. Yarn Y is fed from a spool, a mandrel or other known means for continuously feeding yarn (not shown) and enters the first end 14 through passageway 18 having the shape of an inverted cone. Yarn Y first passes through the relatively wide portion 18*a* of the passageway and then passes through an aperture in its tip 18*b*. Tip 18*b* is in communication with a first hollow member 20 having walls defining a hollow interior. The inside diameter of member 20 should only be slightly greater than the diameter of the yarn Y, but should permit a yarn to move through it.

At the second end 16 of the housing 12, second hollow member 22 extends from within the housing to 12 to beyond the second end 16. Second hollow member 22 passes through sealing member 24. The first hollow member 20 is placed inside the second hollow member 22 in a telescoping arrangement. Its inside diameter is greater than the outside diameter of the first hollow member 20. Yarn Y extends through the second hollow member 22 to the distal end 22*a* thereof. At distal end 22*a*, the yarn is threaded through the opening of a needle 26. The needle resides within the distal end 22*a*. A screw or chuck 28 secures the needle within the distal end 22*a*.

As noted, the lower end of the first hollow member 20 is located within the second hollow member 22 in a telescoping arrangement within the housing 12. In this embodiment, the first hollow member 20 is fixed in place by fittings 30 and 32, which form a secure fit between the walls of the housing 12 and first hollow member 20. On the other hand, second hollow member 22 can slidably move along its longitudinal axis and is mounted over the lower end of first hollow member 20. Second hollow member 22 slides through sealing member 24, its distal end 22*a* and needle 26 movable away from the housing 10. When yarn Y is threaded through the hollow members and through the opening, movement of the second hollow member will move yarn Y away form the housing 10. The second hollow member 22 is fitted within piston 34, which is a disk corresponding to the shape of the housing 12 and which is in contact with and slides along the interior housing wall. In essence, the second hollow member 22 is a piston rod that is slidably mounted within the housing 12, and can drive needle 28 and Yarn Y away from the housing into a reinforcement material.

The skilled artisan will appreciate that there are several ways in which to actuate the slidable movement of the second hollow member 22, such as pneumatically, mechanically, electro-mechanically, and electrically. FIG. 1 shows a yarn insertion mechanism that is pneumatically actuated. In this embodiment, the interior of the housing is subdivided into four zones or compartments A, B, C, and D, each of which is sealed off from the other zones. Zone A is sealed off by fittings 30 and 32. Zone B is sealed off by fitting 33 and piston 34, and Zone C is sealed off by piston 34 and sealing member 24 located at second end 16. Zone D is vented to the atmosphere and is sealed by fittings 32 and 33. Each zone is respectively provided with nozzles 40, 42 and 44 through which a pressurized fluid, such as compressed air, can enter the zone, as well as exit the zone, by way of a hose or line (not shown) which is in communication with a pressurized fluid source (not shown). In this embodiment, the second hollow element 22 and yarn Y traveling within it is actuated away from the housing 10 to effect yarn insertion when pressurized fluid is fed to zone B. The second hollow member 22 is actuated upwardly, or in other words in the direction of retraction of the second hollow member, when the pressure in zone C exceeds that in zone B. Ordinarily, this will be effected by releasing the pressurized fluid from zone B and applying pressurized fluid in zone C.

In zone B, there is provided a first yarn brake arrangement 46. Brake pad 48 is fitted within aperture 50 which is located on the second hollow member. Spring 52 extends over aperture 50 and biased against brake pad 48. A rubber bladder 54 or the like is fitted over the brake pad arrangement 46. The first yarn brake arrangement 46 is actuated by the build-up of pressurized fluid in zone B.

In Zone A, a second yarn brake arrangement 56 is provided. The second yarn brake arrangement is identical to the first yarn brake arrangement, except that brake pad 58 is fitted within an aperture 60 within the stationary first hollow member 20. The second yarn brake arrangement 56 is actuated by the build-up of pressurized fluid in zone A.

The first and second yarn brakes of this embodiment are actuated pneumatically. When a pressurizing fluid enters zones A and B, elevated pressure engages brake pads 48 or 58 against yarn Y, which effects the restraint necessary to either actuate movement of the yarn out of the housing and into the reinforcement, or to prevent upward actuation of the yarn or buckling of the yarn after insertion. This will be explained below.

The operation and use of the yarn insertion mechanism will now be described. Yarn Y enters the housing at first end 14 and is threaded through the telescoping arrangement defined by the first and second hollow members 20, 22. Yarn Y is threaded through needle 26, which is fixed to the distal end 22 of second hollow member 22.

Initially, the fluid pressure in zones A, B and C is insufficient to actuate the components in these zones. Ordinarily, this means that no fluidizing pressure is being applied, and that the pressure is the atmosphere pressure. In this condition, the tension of the springs 52 holds the brake pads 48, 58 out of engagement with the yarn, so that the yarn can be threaded.

When air pressure is applied in Zone B, first yarn brake arrangement 46 is actuated. Brake pad 48 is pushed against yarn Y by the pressure build-up in the zone. Also, the pressure build-up moves piston 34 downwardly. In turn, this moves the second hollow member 22 and needle 26 away from the housing, towards the reinforcement material and then into the reinforcement material. Yarn Y travels with the second hollow member since the brake pad 48 of first yarn brake arrangement is engaged against the yarn. By positioning the needle above a reinforcement material and actuating the yarn insertion mechanism as described above, the needle bores through the reinforcement material, creating a substantially longitudinal path for the second hollow member and yarn Y. Yarn Y is inserted along this substantially longitudinal path.

After insertion of yarn Y, removal of the needle 26 and second hollow member 22 without displacement or buckling of yarn Y is effected as follows. The fluidizing pressure is released from zone B, disengaging first yarn brake arrangement 46 from yarn Y. Simultaneously, fluidizing pressure is applied to zones A and C. The application of fluidizing pressure in zone A actuates the second yarn brake arrangement 56 located in the stationary first hollow member 20 in the manner described with respect to the first yarn brake arrangement.

The application of fluidizing pressure in zone C causes piston 34 to move upwardly, moving the second hollow member 22 and the needle 26 out of the reinforcement material and retracting the second hollow member 22 into the housing 12. The upward movement of the piston 34 is eventually stopped by a piston stop 62 placed above the piston 34 in zone B. While the second hollow member 22, piston 34, and needle 26 are retracting, yarn Y is held stationary, since the second yarn brake arrangement 56 located in the stationary first hollow member 20 is engaged against the yarn by the build-up of pressure in zone A. Furthermore, since the inside diameters of the first and second hollow members are only slightly greater than the yarn diameter, the first and second hollow members maintain the yarn in a longitudinal path, preventing yarn buckling. That is, the yarn is constrained and cannot move, maintaining yarn Y in place within the reinforcement material while the second hollow member 22, piston 34, and needle 26 are retracted. This is the case even though the opening of the needle is sliding over the yarn during retraction.

In the aforedescribed embodiment, the yarn brake arrangements are pneumatically actuated, but they need not be so. For instance, the yam brake arrangements may be actuated pneumatically, mechanically, electro-mechanically, and electrically. If actuation is not effected by pneumatic means, it may not be necessary to compartmentalize the housing into sealed zones.

Figure 3:
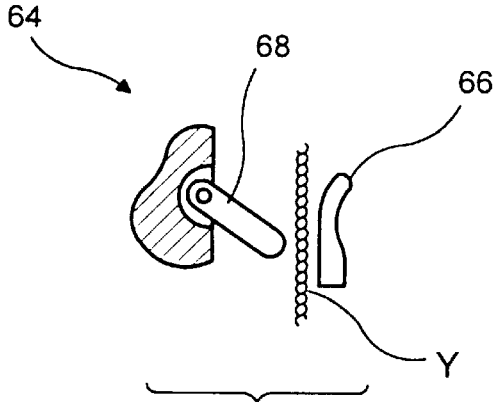
FIG. 3 is a perspective view of another alternative yarn brake arrangement.

An alternative arrangement for a yarn brake arrangement is shown in FIG. 3. Yarn brake arrangement 64 is provided with a fixed stop or pad 66. Rotating arm or cam 68 is actuated to pivot into yarn Y and fix it in place against pad 66. This is an example of a mechanical yarn brake arrangement that eliminates the need for the components of a pneumatic system.

Figure 2:
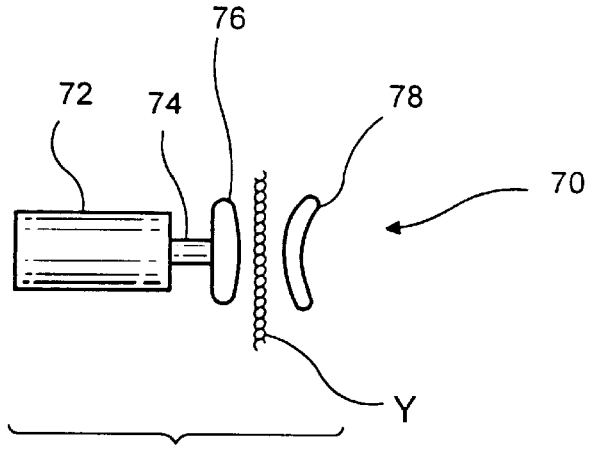
FIG. 2 is a perspective view of alternative yarn brake arrangement.
Figure 4:
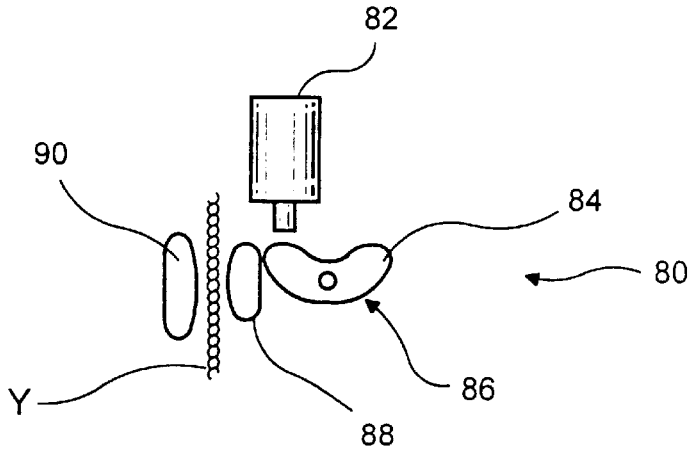
FIG. 4 is a perspective view of yet another alternative yarn brake arrangement.

In FIGS. 2 and 4, two other pneumatically actuated yarn brake arrangement 70 and 80 are depicted. In FIG. 2, when air actuated cylinder 72 is pressurized, brake pad 76 affixed to rod 74 is actuated against yarn Y, braking it against fixed pad 78. This arrangement is akin to a direct squeeze upon the brake pad. Releasing pressure from air cylinder 72 releases brake pad 76 from yarn Y.

In FIG. 4, air cylinder 82 is actuated against cam 84 arranged on pivot 86. Actuation causes the cam 84 to pivot, thereby displacing brake pad 86 against yarn Y. Yarn Y is fixed in place between brake pad 88 and fixed pad 90. This is akin to an indirect squeeze. In a variation of this embodiment, the rotating cam 84 can pivot directly into the yarn Y, thereby eliminating the need for a brake pad.

Figure 5:
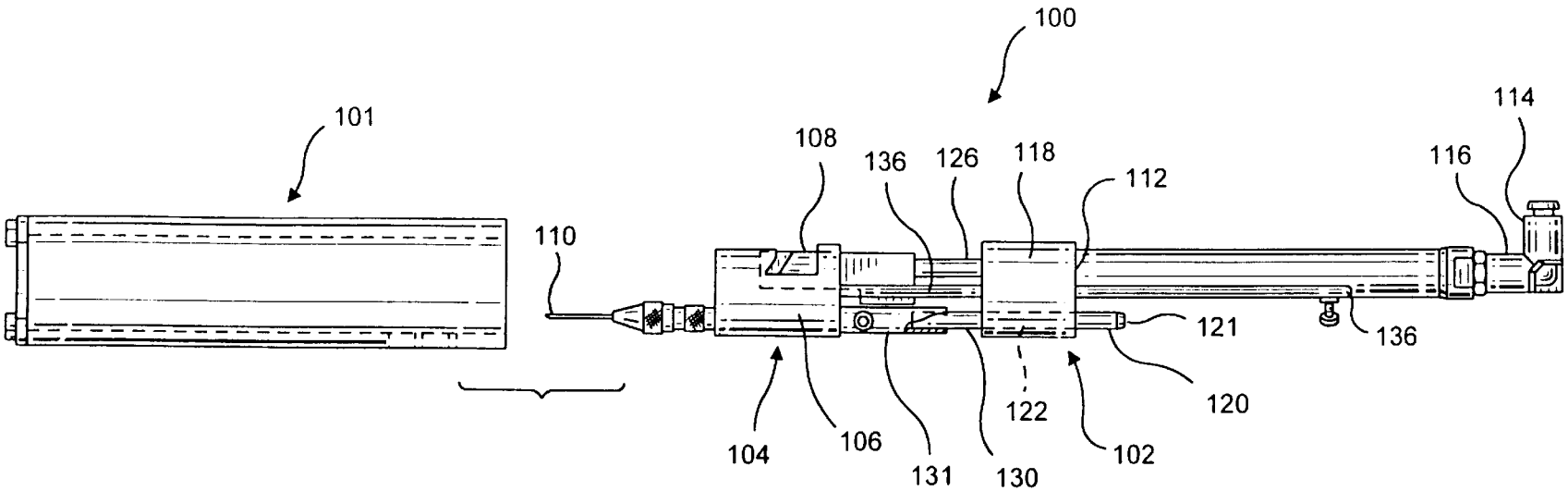
FIG. 5 is a perspective view of another embodiment of the present invention.
Figure 7:
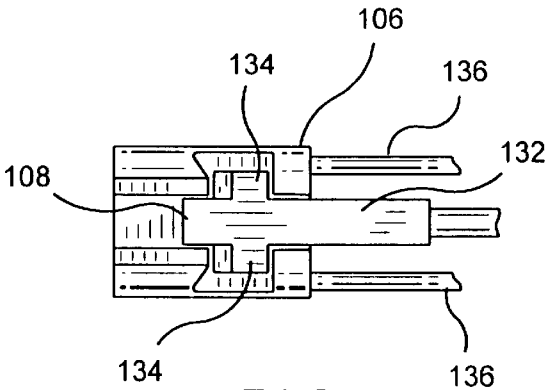
FIG. 7 is a top plan view of an aspect of the FIG. 5 embodiment.

Another embodiment of the invention is depicted in FIGS. 5 to 9. In FIG. 5, a yarn insertion mechanism 100 is shown having a driver component 102 and yarn carrier mechanism 104 fitted within a housing 101.

During operation, driver component 102 is mounted within housing 101, remaining stationary. Driver component 102 drives the yarn carrier mechanism 104 to effect yarn insertion. The yarn carrier mechanism 104 has a lower portion 106 and upper portion 108 that fit together in a complimentary arrangement. A hypodermic needle 110 is affixed to the distal end of the lower portion 106. Yarn Y is threaded through driver component 102, yarn carrier mechanism 104, and hypodermic needle 110. This is the general arrangement; the specific arrangement is described with particularity below.

Still referring to FIG. 5, driver component 102 is provided on its rear face 112 with a tubular inlet 114 for receiving pressurized fluid from a pressurized fluid source (not shown). Tubular inlet 114 is in communication with the driver component 126 by way of conduit 116 which enters the body 118. Inside the body, there is provided a tunnel (not shown) that serves as a flow path for the pressurized fluid that enters the body. Driver element 126 extends out of the tunnel for the pressurized fluid, and is actuable in an outward direction in response to the application of pressurized fluid. When actuated, the driver element 126 moves out of the conduit 116 in the direction of the yarn carrier mechanism 104. When pressure actuated, driver element 126 is attached the upper portion 108 of the yarn carrier mechanism 104 and moves it forward with the driver element 126.

Yarn enters the body 118 of driver component 102 through entranceway 120 provided on the rear face 112, and passes through the driver component 102 via a tunnel 122. Entranceway 120 is depicted as a tubular extension off of the driver component 102. Yarn passes through tunnel 122 and tube 123 on its way through tube yarn carrier mechanism 104.

Figure 6:
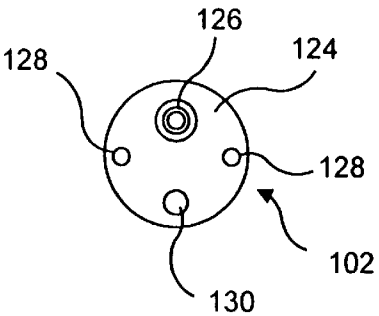
FIG. 6 is a perspective view of an aspect of the FIG. 5 embodiment.

FIG. 6 shows the front face of the driver component 102, or in other words, the side which faces the yarn carrier mechanism 104. The driver element 126 extends out of the tunnel for the pressurized fluid. When pressurized fluid is supplied to the driver component 102, driver component is actuated, moving out of the driver component in response to pressurization.

The front face 124 is further provided with first and second tunnels 128 for receiving guide members 136 that extend from the yarn carrier mechanism 104. The front face is also provided with yarn tube 130 which is in communication with tunnel 122. Yarn tube 130 extends from the front face 124, and the yarn passes through it on its way to the yarn carrier mechanism 104.

Yarn carrier mechanism 104 is constructed of upper portion 108 and lower portion 106. The lower portion 106 is a solid body construction provided with a slotted or grooved profile on its upper face. The slotted profile complements and receives the shape of the upper portion 108. This arrangement can be seen in FIG. 7, where it is shown that upper portion 108, having a longitudinal body portion 132 and wings 134, is cross-shaped, and lower portion 106 is slotted in a complementary way in order to receive the upper portion 108.

As shown in FIG. 5, driver 126 extends from the driver component 102 and is affixed to the rear side of yarn carrier mechanism 104. Driver 126 moves outwardly due to pressurization, pushing upper portion 108 of the yarn carrier mechanism 104 in the direction of yarn insertion. As the wings 134 of upper portion 108 engage the inner walls of the profiled lower portion 106, the lower portion 106 is driven outwardly as well, and at this time, the entire yarn carrier mechanism 104 moves in the direction of yarn insertion. Driver 126 is a means for actuating the means for moving yarn.

Lower portion 106 of yarn carrier mechanism 104 is further provided with extending guide members 136 which extend from the rear side of the lower portion 106. These guide members are located and dimensioned to fit within the tunnels 128 on the front side 124 of the driver component 102. Lower portion 106 is further provided with a yarn tube 131 which receives, in a telescoping arrangement, the yarn tube 130 extending from the front face of 114 of the stationary driver component 102. During the movements associated with insertion and retraction, the guide members 136 slide in and out of tunnels 128 while remaining within them. Likewise, the yarn travels through the tunnel in the stationary driver component 102, through yarn tube 130, through yarn tubes 131 and tunnel 156 in the lower portion 106 of the yarn carrier mechanism 104 and then through the hypodermic needle 110. Yarn tube 130 extending from the driver component and yarn tube 131 extending from the yarn carrier mechanism 104 are in a telescoping relationship. It should be readily understood that the tunnels in the stationary driver component 102, the yarn tube 131 and tunnel 156 in the lower portion 106 of the yarn carrier mechanism 104, and the yarn tube 130 have a diameter only slightly greater than the diameter of the yarn and constitute a means for maintaining yarn in a longitudinal path.

Figure 8:
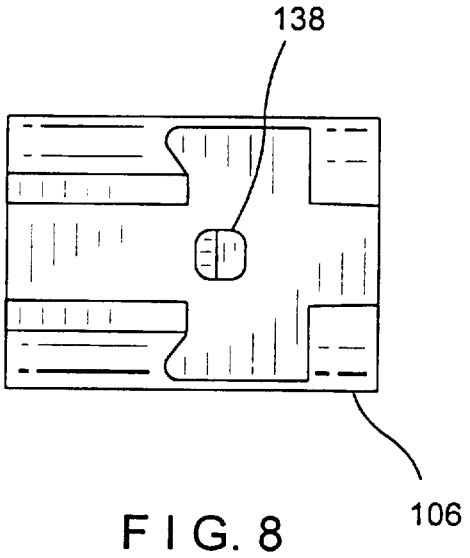
FIG. 8 is a is a top plan view of an aspect of the FIG. 5 embodiment.
Figure 9:
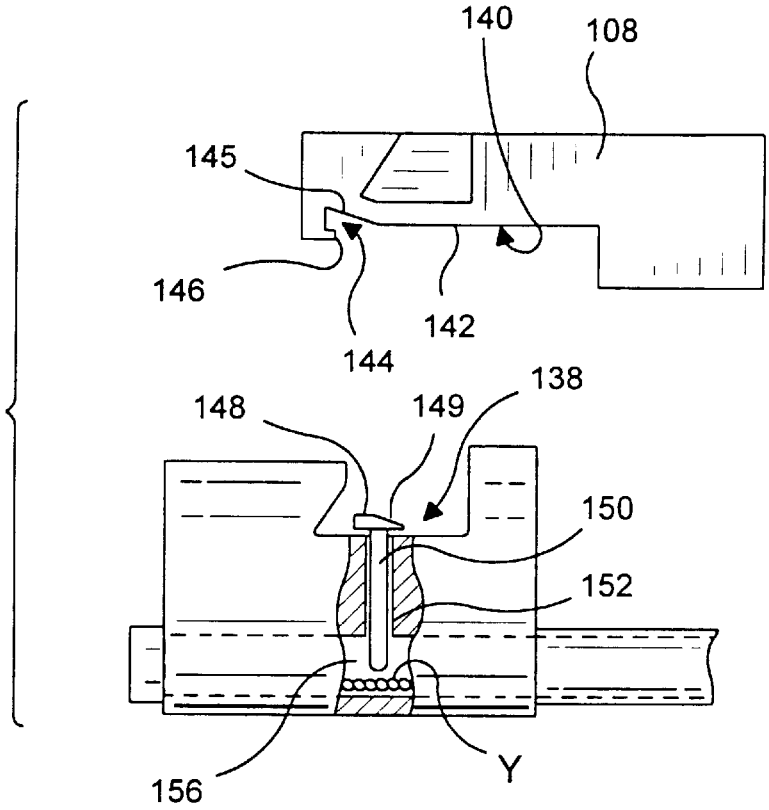
FIG. 9 is an exploded view of an aspect of the FIG. 5 embodiment.

FIG. 8 is a top plan view of the lower portion 106 yarn carrier mechanism 104, with the upper portion 108 removed, revealing the yarn brake 138. FIG. 9 shows an exploded view of a yarn carrier mechanism 104, more clearly showing the interrelationship of the upper portion 108 and lower portions 106, and yarn brake 138. Upper portion is provided with a lower surface 140 that is planar for a portion 142 of its length then has a triangular cut-out portion formed by an angled wall portion 145 that is part of groove 144, which is provided with a hook 146 at the wall opposite the angled wall portion 145 of the triangular cut-out portion.

As shown in FIG. 9, yarn brake 138 is constituted of a head 148 and pin 150. Pin 150 extends through aperture 152 into yarn tube 156, just above yarn Y. Head 148 has an angled surface 149 that is complementary to the surface of the angled wall portion 145 of the groove 144. As upper portion 108 of the yarn carrier mechanism 104 slides forward in lower portion 106 in response to being pushed by the driver member 126 of the stationary driver component 102, the angled wall portion 145 of the groove 144 engages the head 148, depressing it, moving the pin 150 downwardly through the aperture 152 into physical engagement with the yarn.

Also, while the upper portion 108 is sliding forward in lower portion 106 of the yarn carrier mechanism 104, the wings 134 of upper portion 108 engage the inner walls of the profiled lower portion 106, driving lower portion 106 outwardly in the direction of yarn insertion. This action occurs simultaneous to, or approximately simultaneous to, the aforedescribed action which effects the depressing of the yarn brake 138 and engagement of yarn Y. The yarn Y moves forward with the yarn carrier mechanism 104, since in this arrangement the pin 150 is in physical engagement with the yarn, that is impinging the yarn against the interior of yarn tube 156. Yarn carrier mechanism is a means for moving yarn in a longitudinal path. By positioning the needle 110 above a reinforcement material and actuating the yarn insertion mechanism as described above, the needle bores through the reinforcement material, creating a substantially longitudinal path for the needle 110 and yarn Y. Yarn Y is inserted along this substantially longitudinal path.

After insertion of yarn Y, removal of the needle 110 without displacement or buckling of yarn Y is effected as follows. The fluidizing pressure is released from inlet 114, which deactivates the driver element 126. A spring located within the body 118 of the driver component 102 biases the driver element 126 towards the retracted position. Thus, when the fluidizing pressure is released, the driver element 126 retracts, pulling the yarn carrier mechanism 104 with it. Specifically, as driver element 126 retracts, it pulls upper portion 108 of yarn carrier mechanism 104 and retracts it. As upper portion 108 retracts, hook 146 on head 148 pulls pin 150 away from the yarn and out of engagement with it in order to insure that the yarn Y is not removed as the mechanism retracts. Further, as upper portion 108 retracts, the wings 134 of upper portion 108 engage the inner walls of the profiled lower portion 106, driving lower portion 106 in the direction of retraction, effecting the retraction movement of the yarn carrier mechanism 104.

At the yarn entranceway 120 of the stationary driver component 102 a yarn brake mechanism 121 is provided in order to keep the yarn from being removed from its inserted position within the reinforcement material while the device is retracted. The yarn brake mechanism is a constrictor which prevents the yarn from traveling our of the tube during retraction. In other words, it is a means for constraining yarn against movement. The constrictor may be a portion of the interior diameter of the yarn entranceway which has a diameter that is the same as, or slightly less than the yarn diameter. The constrictor applies a drag force to the yarn which prevents it from traveling upward with the mechanism as the yarn carrier mechanism is retracted from the insertion position.

I claim:

1. An apparatus for longitudinally inserting yarns into a reinforcement material comprised of a housing having a first end for receiving yarn and a second end for passing yarn, the first and second ends being in communication with means for maintaining yarn in a longitudinal path within the housing, means for moving yarn in the longitudinal path within the housing between an initial position and a second position corresponding to where yarn has been inserted into a reinforcement material, means for actuating the means for moving yarn between the initial position and the second position, means for constraining yarn against movement, and means for boring a longitudinal path in a reinforcement material.

2. The apparatus of claim 1 wherein the means for maintaining yarn in a longitudinal path is comprised of at least one hollow member extending longitudinally through the housing.

3. The apparatus of claim 2 wherein the means for maintaining yarn in a longitudinal path is comprised of first and second hollow members arranged telescopically.

4. The apparatus of claim 1 wherein the means for moving yarn in a longitudinal path is in a movable arrangement comprised of movable means for maintaining the yarn in a longitudinal path, wherein said movable means are movable between an initial position and a second position where yarn has been inserted into a reinforcement material, and means for engaging yarn positioned on the movable means for maintaining the yarn in a longitudinal path and traveling therewith.

5. The apparatus of claim 4 wherein the movable means for maintaining yarn in a longitudinal path is comprised of first and second hollow members arranged telescopically wherein at least one of the first and second hollow members is longitudinally movable within the housing.

6. The apparatus of claim 1 wherein at least one of the means for engaging yarn and the means for constraining yarn against movement is a yarn brake arrangement comprised of a rubber bladder and a spring encasing a brake pad positioned within an aperture.

7. The apparatus of claim 1 wherein the means for engaging yarn and the means for constraining yarn against movement are yarn brake arrangements comprised of a rubber bladder and a spring encasing a brake pad positioned within an aperture.

8. The apparatus of claim 1 wherein the means for constraining yarn against movement is a hollow member having an inside diameter slightly greater than the yarn.

9. The apparatus of claim 4 wherein at least one of the means for engaging yarn and the means for constraining yarn against movement is a yarn brake arrangement comprised of a rubber bladder and a spring encasing a brake pad positioned within an aperture.

10. The apparatus of claim 4 wherein the means for engaging yarn and the means for constraining yarn against movement are yarn brake arrangements comprised of a rubber bladder and a spring encasing a brake pad positioned within an aperture.

11. The apparatus of claim 10 wherein the means for actuating yarn movement is a piston coupled to the means for maintaining the yarn in a longitudinal path, the piston being actuable pneumatically, electronically, mechanically or electro-mechanically.

12. The apparatus of claim 1 wherein the apparatus is further comprised of at least one zone located within the housing having means for receiving pressurized fluid from a pressurized fluid source, said zone being defined by the interior wall of the housing and first and second means for preventing the exit of pressurized fluid from the zone.

13. The apparatus of claim 12 wherein one of the first and second means is a piston coupled to the means for maintaining the yarn in a longitudinal path.

14. The apparatus of claim 12 wherein the zone is further comprised of a pneumatically-actuated yarn brake arrangement comprised of a rubber bladder and a spring encasing a brake pad positioned within an aperture in the means for maintaining the yarn in a longitudinal path.

15. The apparatus of claim 14 wherein the pneumatically-actuated yarn brake arrangement is movable within the zone.

16. The apparatus of claim 14 wherein the pneumatically-actuated yarn brake arrangement is fixed to a stationary location within the zone.

17. The apparatus of claim 14 further comprised of at least two zones each having a pneumatically-actuated yarn brake arrangement, the first yarn brake arrangement movable within the zone, and the second yarn brake arrangement is fixed to a stationary location within the zone.

18. The apparatus of claim 17 further comprised of at least three zones wherein a piston coupled to the means for maintaining the yarn in a longitudinal path is one of the first and second means defining the zone containing the first yarn brake arrangement movable within the zone.

19. The apparatus of claim 1 wherein the means for boring a longitudinal path in a reinforcement material is a needle provided with an opening for receiving the yarn.

20. The apparatus of claim 4 wherein the apparatus is further comprised of at least one zone located within the housing having means for receiving pressurized fluid from a pressurized fluid source, said zone being defined by the interior wall of the housing and first and second means for preventing the exit of pressurized fluid from the zone.

21. The apparatus of claim 20 wherein one of the first and second means is a piston coupled to the movable means for maintaining the yarn in a longitudinal path.

22. The apparatus of claim 20 wherein the means for engaging yarn is a pneumatically-actuated yarn brake arrangement located within the zone comprised of a rubber bladder and a spring encasing a brake pad positioned within an aperture in the means for maintaining the yarn in a longitudinal path.

23. The apparatus of claim 19 further comprised of means for constraining yarn against movement located at a fixed location within the zone, wherein said means is a pneumatically-actuated yarn brake arrangement comprised of a rubber bladder and a spring encasing a brake pad positioned within an aperture in the means for maintaining the yarn in a longitudinal path.

24. The apparatus of claim 23 further comprised of at least a second zone, wherein the means for engaging yarn is a pneumatically-actuated yarn brake arrangement located within the second zone comprised of a comprised of a rubber bladder and a spring encasing a brake pad positioned within an aperture in the movable means for maintaining the yarn in a longitudinal path.

25. The apparatus of claim 24 further comprised of at least three zones wherein a piston coupled to the means for maintaining the yarn in a longitudinal path is one of the first and second means defining the second zone.

26. The apparatus as set forth in claim 1 wherein the means for maintaining yarn in a longitudinal path is comprised of at least one tunnel having a diameter slightly larger than the diameter of the yarn.

27. The apparatus as set forth in claim 1 wherein the means for maintaining yarn in a longitudinal path is comprised of at least one tunnel and at least one tube having a diameter slightly larger than the diameter of the yarn.

28. The apparatus as set forth in claim 1 wherein the means for moving yarn in a longitudinal path between an initial position and a second position corresponding to where yarn has been inserted into a reinforcement material is comprised of a yarn carrier mechanism that includes:

a lower portion having an inlet for receiving yarn, a tunnel for passing yarn, an outlet for passing yarn to the means for boring a longitudinal path in a reinforcement material, the lower portion having a top surface profiled to receive an upper portion, an aperture located on the top surface, said aperture being in communication with the tunnel for passing yarn, a yarn brake positioned within the aperture, an upper portion having profile complementary to the profile of the lower portion, the upper portion including a bottom surface with a profile that provides for engagement and disengagement of the yarn brake.

29. The apparatus as set forth in claim 28 wherein the means for maintaining yarn in a longitudinal path is comprised of a yarn pathway including a tunnel passing through the driver component, a yarn tube extending from the driver component and into the yarn carrier mechanism, and a tunnel in the yarn carrier mechanism, the yarn pathway having a diameter slightly larger than the diameter of the yarn.

30. The apparatus as set forth in claim 28 wherein the top surface of the lower portion has a cross-shaped profile in the form of a groove in which receive a cross-shaped upper portion is received.

31. The apparatus as set forth in claim 30 wherein the groove is slightly larger than the cross-shaped upper portion.

32. The apparatus as set forth in claim 30 wherein the bottom surface of the upper portion is comprised of a planar portion, a groove including an angled wall portion that is angled between 0° and 90° with respect to the planar portion, and a hook provided at the wall opposite the angled wall portion 145 of the triangular cut-out portion.

33. The apparatus as set forth in claim 30 wherein the yarn brake is comprised of a head and a pin, the head being positioned in the aperture on the lower portion of the yarn carrier mechanism and the pin being positioned in the aperture of the yarn carrier mechanism.

34. The apparatus as set forth in claim 33 wherein the head has an angled portion that is complimentary to the groove of the upper portion of the groove of the upper portion of the yarn carrier mechanism.

35. The apparatus as set forth in claim 1 wherein the means for actuating the means for moving yarn between the initial position and the second position, is an actuated driver which in response to actuation moves out of the driver component and engages the yarn carrier mechanism between the initial position and the second position.

36. An apparatus for longitudinally inserting yarns in a reinforcement material comprising a housing having an upper end and a lower end, openings at the upper and lower ends, sealing members dividing the interior of the housing into first, second and third sealed zones, each of said zones being provided with means for receiving a pressurized fluid, first and second telescopically arranged hollow members mounted longitudinally in the housing, in communication with the openings at the upper and lower ends, wherein the first member is mounted in place in the housing and the second member is movable longitudinally, said first and second hollow members having an inside diameter slightly greater than the diameter of a yarn, said second hollow member being movable between an initial position and a second position corresponding to the insertion of yarn in a reinforcement material, wherein the first hollow member has an aperture located within the first sealed zone and a pneumatically-actuated yarn brake arrangement positioned within the aperture, the yarn brake arrangement comprised of a rubber bladder and a spring encasing a brake pad positioned within the aperture, wherein the second sealed zone contains the telescoping portion of the first and second members and the second hollow member is provided with an aperture having a pneumatically-actuated yarn brake arrangement positioned within the aperture, the yarn brake arrangement comprised of a rubber bladder and a spring encasing a brake pad positioned within the aperture, and wherein the lower seal of the second zone is a piston fitted against the interior of the housing, and a needle having an opening affixed to the lower end of the second member, said second member and needle being movable away from the lower end of the housing.

* * * * *